US006666353B1

(12) United States Patent
Olivier

(10) Patent No.: US 6,666,353 B1
(45) Date of Patent: Dec. 23, 2003

(54) TUBE ORGANIZER AND DISPENSING AID

(76) Inventor: Emile Roland Olivier, 267 Roswell Commons Cir., Roswell, GA (US) 30076

( * ) Notice: Subject to any disclaimer, the term of this patent is extended or adjusted under 35 U.S.C. 154(b) by 0 days.

(21) Appl. No.: 10/227,497

(22) Filed: Aug. 22, 2002

(30) Foreign Application Priority Data

Jul. 24, 2002 (AU) ..... 2002300255

(51) Int. Cl.[7] ..... B65D 35/56

(52) U.S. Cl. ..... 222/105; 222/95; 222/179.5; 222/180; 222/490

(58) Field of Search ..... 222/92, 95, 105, 222/107, 173, 179.5, 180, 490

(56) References Cited

U.S. PATENT DOCUMENTS 1,607,993 A * 11/1926 Loewy ..... 222/490
1,892,140 A * 12/1932 Fogler ..... 222/105
1,984,610 A * 12/1934 Warren ..... 222/105
2,076,826 A * 4/1937 Reinsberg ..... 222/105
2,078,149 A * 4/1937 Lutz ..... 222/105
3,817,426 A * 6/1974 Fooks ..... 222/105
4,778,082 A * 10/1988 Vitelle ..... 222/95

* cited by examiner

*Primary Examiner*—Gene Mancene
*Assistant Examiner*—Patrick Buechner
(74) *Attorney, Agent, or Firm*—Kennedy Covington Lobdell & Hickman, LLP

(57) ABSTRACT

A tube organizer and dispensing aid (toda) is disclosed. The device is comprised of a base 3, which has means of anchoring to a supporting surface and has a receptacle 11 for receiving and holding a nozzle 2 with a tube of flowable substance attached; a self-closing, universal and removable nozzle 2 for regulating the flow of the flowable substance and for securing the tube in the base 3 and closing the dispensing aperture 10 to the environment; and a consolidator 6 which slips over the tail of the tube and is used to maintain the flowable substance toward the dispensing end of the tube. This device is intended to alleviate all the known difficulties associated with the use of tubed substances.

12 Claims, 4 Drawing Sheets

FIG. 3.
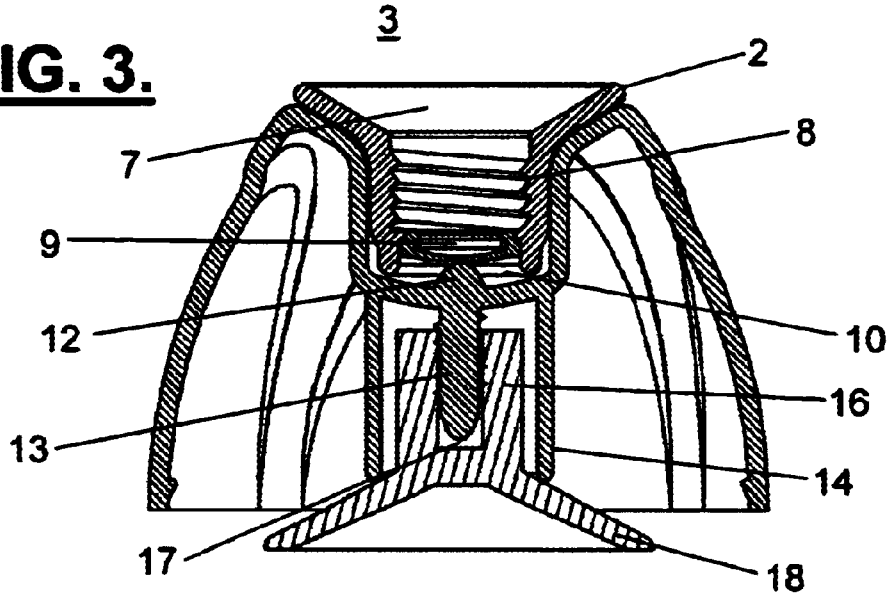
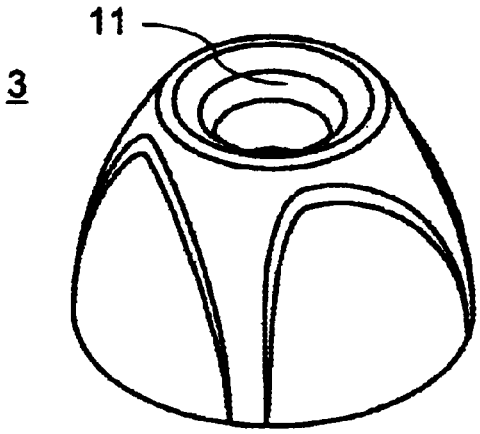
FIG. 4.
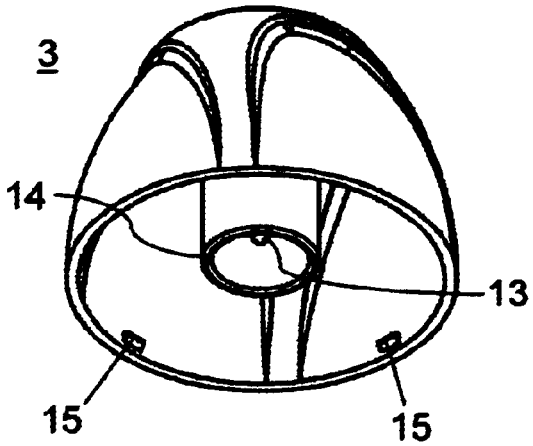
FIG. 5.

TUBE ORGANIZER AND DISPENSING AID

BACKGROUND OF THE INVENTION

This invention relates to improvements to devices for holding, storing, presenting and facilitating the dispensing of substances from tubes such as those in which many substances are sold today. This invention relates particularly but not exclusively to use with toothpaste from a tube and it will be convenient to describe the invention with reference to this example application. However, it is to be clearly understood that the invention is capable of much broader application. It can be applied to the use of other substances presented to the consumer in tubes, e.g. skin cream, hair gel and the like.

Tubes of toothpaste are well known in everyday life and have been widely extant because the tube is such an economical method of packaging. There are, however, a number of difficulties associated with the use of tubes in the actual dispensing process that previous devices and manufacturing processes have failed to eliminate. Primary of these is the necessity of having to locate and retrieve the tube for each use. Often the tube is placed in a drawer, a cabinet or some other storage place and must be located and removed with each use. Alternatively, the tube is left within view and, as its contents are used, the tube becomes dented, twisted, and otherwise unsightly. Another difficulty is that the cap on the tube needs to be removed or flipped open and then replaced or flipped closed with each use. Although the flip-top cap makes it easier to dispense, it often becomes clogged with paste and cannot be easily closed, resulting in paste continuing to flow after the tube has been put away. Also, as the toothpaste is used up, pressing the tube causes some of the paste to flow upward in the tube rather than toward the dispensing end. Inevitably, one is forced to consolidate the paste toward the dispensing end of the tube by starting at the tail of the tube and squeezing continuously downward. Finally, try as one might, it is almost impossible to remove for use all the toothpaste in the tube: There is usually a significant bit within the shoulder of the tube that is most difficult to expel without using two hands.

Many contrivances have been devised to ameliorate these disadvantages, yet they remain. Many of these devices have been too expensive to manufacture and the consumer is unwilling to pay a high a price for the ridding of these nuisances. Some devices are too bulky, clumsy and unappealing. Other devices, such as those that mechanically roll or slide down the tube are often messy, expelling paste when not intended. Attempting to resolve these difficulties at the tube design and manufacturing stages have also been mostly unsuccessful, resulting at best with a tube with oversized cap that can stand but is easily knocked over. Some designs have been made for tubes with self-closing seals, but these have not been widely accepted and require the self-closing mechanism to be applied during the manufacturing process for each tube.

These difficulties are overcome in the present invention that provides a tube organizer and dispensing aid.

In one form of the invention, this tube organizer and dispensing aid, or toda, is comprised of a base for mounting to a support surface, a universal removable nozzle for regulating the flow of the substance and a consolidator for maintaining the bulk of substance toward the dispensing end of the tube.

In another form of the invention, this toda is comprised of a base for mounting to a support surface, a universal seat into which a tube can be screwed and secured, an internal channel for transporting the substance to the dispensing aperture, a self-closing valve on the dispensing aperture, and a consolidator slide for expelling the substance from the tube.

SUMMARY OF THE INVENTION

This invention relates to generally to the field of devices for holding, organizing, presenting and aiding in the dispensing of flowable substances from flexible tubes in which they are stored. This "toda" is comprised of a base for mounting to a support surface, a dispensing nozzle for regulating the flow of the flowable substance and a consolidator for maintaining the bulk of flowable substance toward the dispensing end of the tube.

The dispensing nozzle for dispensing a flowable material from a tube has a dispensing aperture; the nozzle having an inlet, an outlet and a bore there between and connecting means adjacent the inlet for fluidly connecting the nozzle to the tube and material retaining means associated with the outlet for retaining material within the nozzle but allowing material to be dispensed in response to application of pressure to the tube. The connecting means may be any suitable means for fluidly connecting the nozzle to the tube. Typically, tubes for use with the dispensing nozzle of the present invention have an external screw thread. Also, typically, the connecting means includes a corresponding threaded portion for threadably connecting the nozzle to the tube.

The retaining means may also be any suitable means capable of retaining the material within the bore and tube under normal circumstances but allowing material to be expelled from the nozzle in response to application of pressure to the tube. It will be appreciated that the type of retaining means may be modified, depending upon the viscosity of the material to be dispensed. In a preferred form of the invention, the retaining means includes a double-crossed cut seal of silicon or other similarly pliant material suitable for use in an injection molding machine, such seal projecting across the bore. Other types of retaining means that may be suitable include a series of vertical and horizontal barriers within the bore, a screen or grid, with corresponding pliant coverings, a valve or the like.

It is generally preferable by users to be able to store tubes such as toothpaste tubes in a vertical manner. Accordingly, it is preferred that the dispensing nozzle include a base portion such that when the tube is not in use, the nozzle, with the tube connected, can rest on or in the base member. Typically, the base member includes a recess complementary to the nozzle for receiving the nozzle therein. The dispensing nozzle of the present invention can dispense the flowable material when pressure is applied to the tube. Pressure is typically applied to such tubes manually. As discussed above, however, this can lead to uneven and unsightly deformation of the tube and/or dead spots within the tube from which material cannot be dispensed. Accordingly, it is preferred that the dispensing nozzle of the invention be also used in association with the consolidator, as previously described.

It is preferable, with the present invention, for the nozzle to be removably connected to the tube so when the tube is emptied, the nozzle can be washed and connected to a fresh tube.

It is an object of the present invention to provide a mechanism that can neatly and securely hold and conveniently organize a tube or tubes of flowable substances and at the same time provide a means for more easily and conveniently using the tube as the dispensing apparatus such as it was clearly designed.

It is another object of the present invention to provide a toda that can be easily and inexpensively manufactured from various plastic materials using injection-molding equipment and the dual injection molding process.

It is another object of the present invention to provide a toda that conveniently presents the tube yet requires minimal space requirements.

It is yet another object of the present invention to provide a toda that relieves the user of the burden of having to repeatedly remove and replace or open and close the cap.

It is another object of the present invention to provide a toda that has a nozzle that will fit any toothpaste tube and most other tubes of like size.

It is another object of the present invention to provide a toda that has a nozzle that provides a hard surface beneath the shoulder of the tube (the tube seat) such that when the tube appears to be empty, the consumer may press the bottom portion of the tube against said surface thereby expelling the last of the flowable substance through the dispensing end of the tube.

BRIEF DESCRIPTION OF THE DRAWINGS

To assist with understanding the invention, reference will now be made to the accompanying drawings that show one example of the invention. The purpose of providing the detailed description is to instruct persons having an interest in the subject matter of the invention how to carry the invention into practical effect. It is to be clearly understood however that the specific nature of this detailed description does not supersede the generality of the preceding broad description. In the drawings:

FIG. 3 is a cross-sectional view of the toda base depicting the nozzle resting within the receptacle in the base for receiving the tube and nozzle assembly.

FIG. 4 and FIG. 5 are three-dimensional views of the toda base of FIG. 1.

DESCRIPTION OF THE PREFERRED EMBODIMENT OF THE INVENTION

Figure 1:
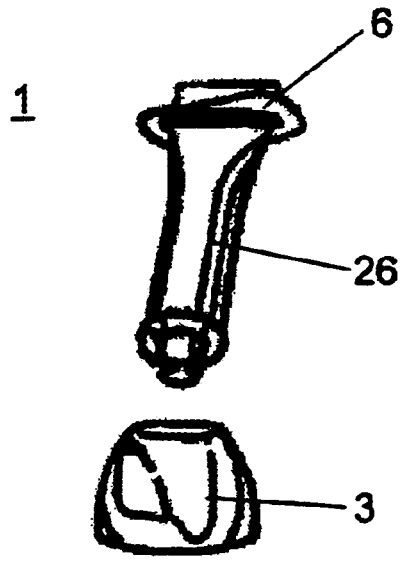
FIG. 1 is a perspective view of the toda in accordance with the present embodiment of the invention.
Figure 2:
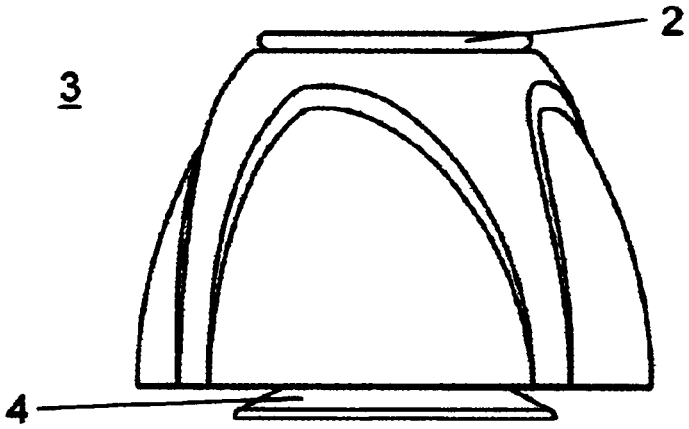
FIG. 2 is a two dimensional view of the toda base of FIG. 1.
Figure 6:
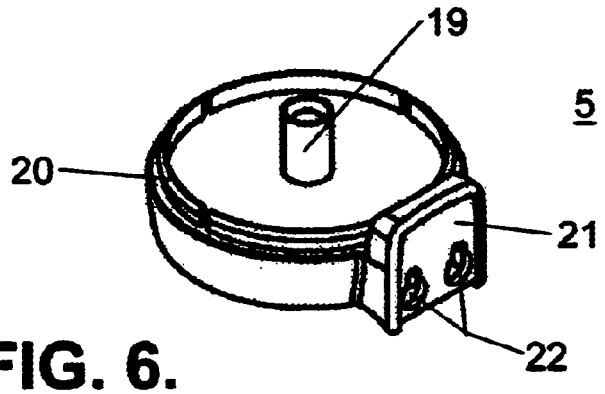
FIG. 6 is a three dimensional view of the toda mounting bracket.
Figure 7:
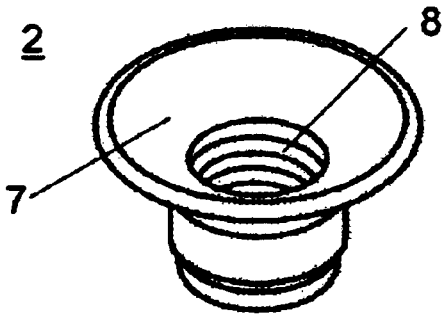
FIG. 7 is a three dimensional view of the nozzle showing internal screw threads.
Figure 8:
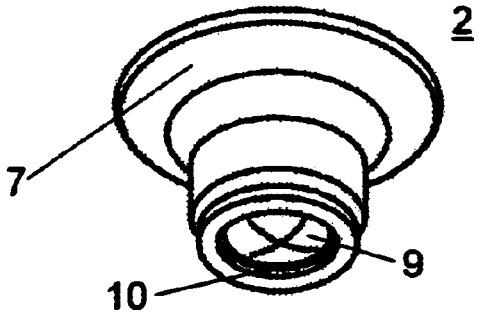
FIG. 8 is a three dimensional view of the bottom of the nozzle showing the seal.
Figure 9:
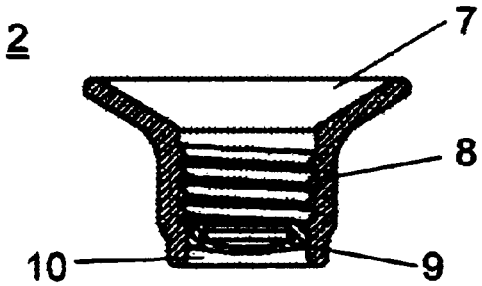
FIG. 9 is a cross-sectional view of the nozzle showing the internal screw threads and the seal.
Figure 10:
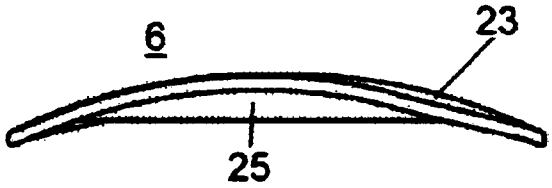
FIG. 10 is a side view of a consolidator.
Figure 11:
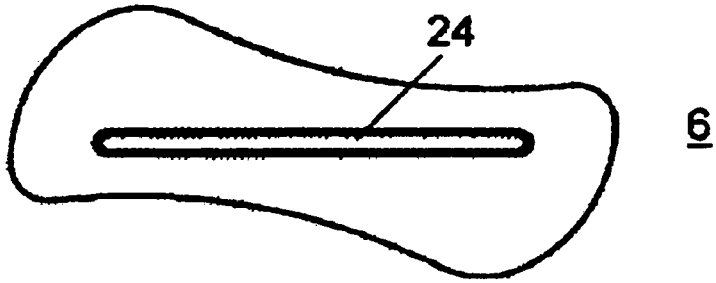
FIG. 11 is a top view of the consolidator of FIG. 9.
Figure 12:
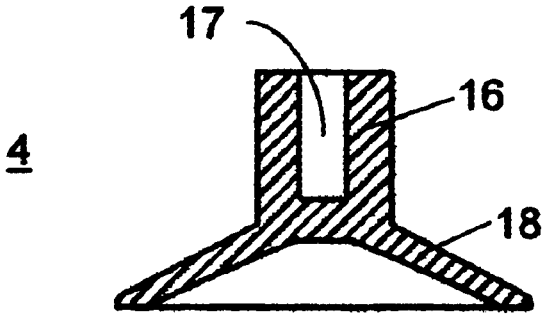
FIG. 12 is a lateral cross-sectional view of a sucker according to the present invention.
Figure 13:
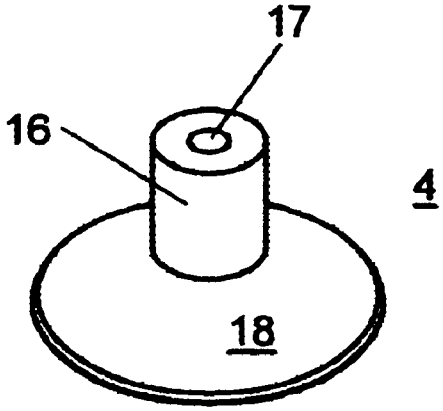
FIG. 13 is a perspective view of a sucker as in FIG. 12.

Referring to the figures starting with FIG. 1, it can be seen that the toda 1 comprises broadly a base 3 with a sucker 4 and bracket 5 for mounting to a support surface (not shown), a nozzle 2, and a consolidator 6. The nozzle 2 is comprised of a tube seat 7; internal threads 8, self-closing seal 9, and a stream-forming bore 10. The base 3 is comprised of the nozzle receptacle 11, the closing bead 12, the sucker locking screw 13, the locking casement 14 and the locking nodules 15. The Sucker 4 is comprised of the shank 16, the locking screw pilot hole 17 and the suction cup 18. The Bracket 5 is comprised of the central pipe 19, the retaining flange and ridge 20, the mounting plate 21 and the mounting holes 22. The consolidator is comprised of the body 23, the guide 25 and the slot 24.

To secure, the consumer first places either the sucker 4 or the mounting bracket 5 in a convenient spot for repeated use. In the case of the sucker 4, it is usually wetted to help form the vacuum and pressed against the horizontal surface such as a vanity top. The base 3, is then attached by means of placing the screw 13 into the locking screw pilot hole 17 and with slight downward pressure, rotating the base 3 clockwise until flush with the horizontal surface. When using the wall bracket 5, the bracket is mounted to the wall using a double faced mounting square placed onto the mounting plate 21 and pressing that firmly against the wall. An alternate mounting method is to fasten two screws to the wall spaced according to the spacing of the screw holes in the mounting plate, leaving the heads protruding to fit into the mounting holes 22. The base 3 is then centered over the mounting bracket by inserting the screw 13 into the central pipe 19 and pressing down until the locking nodules 15 on the base snap and lock over the retaining flange and ridge 20 of the mounting bracket.

A tube 26, is connected to the nozzle 2 by means of the internal threads 8, which receive the external threads of the tube. This assembly is then inserted into the receptacle 11 of base 3 where it is securely held in the upright position. The consolidator 6 is then slid over the tail of the tube by inserting the tail of the tube through the slot 24. The guide 25 eases the substance of the tube downward as the consolidator 6 is slid vertically down the tube 26.

The substance is dispensed from the tube by lifting the assembly of tube 26, nozzle 2, and consolidator 6, placing the forming bore 10 of the nozzle 2 over the receiving surface and squeezing the tube 26. The self-closing seal 9 opens when pressure is applied to the contents of the tube 26, allowing the substance to flow onto the receiving surface. When pressure is removed, the self-closing seal 9 closes. If, as may happen with a very thick substance, the seal does not completely close, it will be nudged back into the closed position by the closing bead 12 at the bottom surface of the nozzle receptacle 11 in the base 3 when the assembly of tube 26, nozzle 2 and consolidator 6 is replaced in the nozzle receptacle 11 of the base 3. The tube 26 can be kept looking neat by occasionally pressing downward on the consolidator 6, thereby coaxing the substance downward in the tube 26. As well as keeping all available substance in an easily dispensable position, such action forces the unsightly indentations out of the tube 26.

The tube seat 7 of the nozzle may be conveniently used to expel any remnants of the substance from the tube 26. This is accomplished by squeezing the wall of the tube 26 against the tube seat 7 with the thumb. This can be accomplished using only one hand whereas presently it is most often necessary to use both hands to accomplish the task. Thus, virtually all of the substance within the tube 26 may be used.

Applicant believes that the invention provides a convenient and simple toda (tube organizer and dispensing aid) that will be extremely useful in many households particularly in environments where there is limited space. It will of course be realized that the above has been given only by way of illustrative example of the invention and that all such modifications and variations as would be apparent to persons skilled in the art are deemed to fall within the broad scope and ambit of the invention as set forth here.

The claims defining the invention are as follows:

1. A toda comprising a removable and reusable universal self-closing nozzle, a consolidator, and a base with a receptacle for accepting and holding a nozzle with a tube attached and a means for anchoring said base to a surface, wherein the toda is anchored to the surface by means of a screw projecting downward from the underside of the base where the screw fits into a bore within a shank of a suction cup such that when the base is turned clockwise it is brought flush with the mounting surface and held in place by the suction cup, a vacuum of which is maintained by a bottom edge of a casement around the screw.

2. The toda of claim 1, wherein the nozzle includes a seal having one or more slits or holes to allow passage of substances therethrough.

3. The toda of claim 1, wherein the nozzle includes a bell-shaped valve for controlling passage of substances therethrough.

4. A toda comprising a removable and reusable universal self-closing nozzle, a consolidator, and a base with a receptacle for accepting and holding a nozzle with a tube attached and a means for anchoring said base to a surface, wherein the means for anchoring comprises a wall mount bracket having a flange with a slight ridge such that the base may snap onto it, a central pipe for accepting the screw and a perpendicularly opposed flat plate with two screw holes for mounting to a vertical surface.

5. The toda of claim 4, wherein the nozzle includes a seal having one or more slits or holes to allow passage of substances therethrough.

6. The toda of claim 4, wherein the nozzle includes a bell-shaped valve for controlling passage of substances therethrough.

7. A toda comprising a removable and reusable universal self-closing nozzle, a consolidator, and a base with a receptacle for accepting and holding a nozzle with a tube attached and a means for anchoring said base to a surface, further comprising an integrated universal seat for accepting a tube, such seat having an internal channel for transporting the paste from the stationary tube to the self-closing dispensing aperture.

8. The toda of claim 7, wherein the nozzle includes a seal having one or more slits or holes to allow passage of substances therethrough.

9. The toda of claim 7, wherein the nozzle includes a bell-shaped valve for controlling passage of substances therethrough.

10. A toda comprising a removable and reusable universal self-closing nozzle having three and a half turns of screw thread into which a tube is screwed, a consolidator, and a base with a receptacle for accepting and holding a nozzle with the tube attached and a means for anchoring said base to a surface, the toda further comprising a ring disposed toward the dispensing end of the bore, said ring having small holes through its thickness around its circumference to anchor a self-closing seal formed over the dispensing aperture using dual injection molding techniques.

11. The toda of claim 10, wherein the nozzle includes a seal having one or more slits or holes to allow passage of substances therethrough.

12. The toda of claim 10, wherein the nozzle includes a bell-shaped valve for controlling passage of substances therethrough.

* * * * *